US009469078B2

(12) United States Patent
Aganovic et al.

(10) Patent No.: US 9,469,078 B2
(45) Date of Patent: Oct. 18, 2016

(54) METHODS AND APPARATUS FOR FORMING A REINFORCED CONTAINER

(71) Applicant: WestRock Shared Services, LLC, Norcross, GA (US)

(72) Inventors: Amer Aganovic, Orlando, FL (US); Thomas Dean Graham, Winter Garden, FL (US)

(73) Assignee: WestRock Shared Services, LLC, Norcross, GA (US)

( * ) Notice: Subject to any disclaimer, the term of this patent is extended or adjusted under 35 U.S.C. 154(b) by 747 days.

(21) Appl. No.: 13/832,674

(22) Filed: Mar. 15, 2013

(65) Prior Publication Data

US 2014/0274634 A1 Sep. 18, 2014

(51) Int. Cl.

*B31B 3/02* (2006.01)
*B31B 3/44* (2006.01)
*B31B 3/52* (2006.01)

(Continued)

(52) U.S. Cl.

CPC . *B31B 3/02* (2013.01); *B31B 1/00* (2013.01); *B31B 3/44* (2013.01); *B31B 3/52* (2013.01); *B65D 5/28* (2013.01); *B31B 2201/2637* (2013.01); *B31B 2201/2691* (2013.01); *B31B 2201/283* (2013.01); *B31B 2203/066* (2013.01); *B31B 2203/084* (2013.01)

(58) Field of Classification Search

CPC ..... B31B 3/00; B31B 3/26; B31B 3/44; B31B 3/46; B31B 3/48; B31B 3/50; B31B 3/52; B31B 3/36; B31B 2201/223; B31B 2201/24; B31B 2201/2637; B31B 2201/267; B31B 2201/2675; B31B 2201/2654; B31B 2201/2658; B31B 2201/2662; B31B 2201/2666; B31B 1/44; B31B 5/14; B65D 5/001; B65D 5/0015; B65D 5/002; B65D 5/003; B65D 5/005; B65D 5/427; B65D 5/44

USPC ..... 493/73–75, 80–81, 136–140, 162, 167, 493/174, 175; 206/509; 229/165–178

See application file for complete search history.

(56) References Cited

U.S. PATENT DOCUMENTS 2,844,076 A * 7/1958 Hoffmeister ..... B31B 1/06 493/126
2,873,655 A * 2/1959 Al Johnson ..... B31B 1/50 493/137

(Continued)

OTHER PUBLICATIONS

PCT/US2014/017791 International Search Report and Written Opinion dated Jun. 6, 2014 (8 pages).

*Primary Examiner* — Stephen F Gerrity
*Assistant Examiner* — Joshua Kotis
(74) *Attorney, Agent, or Firm* — WestRock IP Legal

(57) ABSTRACT

An apparatus for forming a container comprises a hopper assembly configured to store a plurality of blanks. Each blank includes a bottom panel, a pair of opposing end panels, at least one stacking tab, at least one inner side panel, and at least one outer side panel. A transport mechanism is positioned below the hopper assembly and is configured to transport a blank of the plurality of blanks from a first position to a second position. A pair of opposing folding plows is positioned below the hopper assembly. The folding plows are configured to rotate the inner side panels and the stacking tabs of the blank as the blank is transported from the first position to the second position. At least one stacking tab bullet is coupled to each folding plow. Each stacking tab bullet is configured to move a respective stacking tab relative to a corresponding inner side panel.

20 Claims, 10 Drawing Sheets

(51) Int. Cl.
*B31B 1/00* (2006.01)
*B65D 5/28* (2006.01)

(56) References Cited

U.S. PATENT DOCUMENTS

| | | | | | |
|---|---|---|---|---|---|
| 3,190,533 | A | | 6/1965 | Larson | |
| 4,581,005 | A | | 4/1986 | Moen | |
| 4,586,643 | A | | 5/1986 | Halabisky et al. | |
| 4,596,542 | A | | 6/1986 | Moen | |
| 4,624,653 | A | * | 11/1986 | McBride | B31B 1/36 493/127 |
| 4,657,527 | A | * | 4/1987 | Moen | B31B 1/44 493/126 |
| 4,690,835 | A | | 9/1987 | Halabisky et al. | |
| 4,798,571 | A | | 1/1989 | Everman et al. | |
| 5,613,933 | A | * | 3/1997 | Pierce, Jr. | B65D 71/36 493/136 |
| 5,632,713 | A | * | 5/1997 | Canning | B31B 1/52 493/137 |
| 6,131,805 | A | | 10/2000 | Gasior | |
| 6,289,651 | B1 | * | 9/2001 | Le Bras | B65D 71/12 493/136 |
| 6,502,698 | B1 | * | 1/2003 | McKenna | B65D 5/0015 206/509 |
| 7,470,226 | B1 | * | 12/2008 | Herrin | B65D 5/0045 493/125 |
| 7,635,080 | B2 | * | 12/2009 | Conway | B65D 5/0025 229/169 |
| 7,815,559 | B1 | * | 10/2010 | Flaming | B31B 1/36 493/183 |
| 8,105,223 | B2 | * | 1/2012 | Graham | B31B 1/36 493/127 |
| 2002/0125308 | A1 | * | 9/2002 | McLeod | B65D 5/0025 229/174 |
| 2006/0100079 | A1 | * | 5/2006 | Graham | B31B 1/36 493/71 |
| 2007/0194093 | A1 | * | 8/2007 | Ford | B65B 5/024 229/144 |
| 2008/0067225 | A1 | | 3/2008 | Moore | |
| 2009/0098991 | A1 | * | 4/2009 | Graham | B31B 1/06 493/162 |
| 2009/0181839 | A1 | * | 7/2009 | Spink | B42F 21/02 493/356 |
| 2009/0272789 | A1 | * | 11/2009 | Fry | B65D 5/0015 229/5.5 |
| 2009/0277952 | A1 | | 11/2009 | Smith | |
| 2010/0044423 | A1 | | 2/2010 | Graham et al. | |
| 2010/0219232 | A1 | | 9/2010 | Smith | |
| 2011/0105290 | A1 | | 5/2011 | Graham et al. | |
| 2011/0177930 | A1 | * | 7/2011 | Criblez | B31B 1/04 493/416 |
| 2011/0281705 | A1 | | 11/2011 | Aganovic et al. | |
| 2011/0294638 | A1 | * | 12/2011 | Tosevski | B31B 1/04 493/123 |
| 2013/0090221 | A1 | * | 4/2013 | Green | B31B 1/00 493/162 |

* cited by examiner

METHODS AND APPARATUS FOR FORMING A REINFORCED CONTAINER

BACKGROUND OF THE INVENTION

The embodiments described herein relate generally to a machine for forming a container from sheet material, and more particularly to a machine for automatically forming a tray that includes reinforced side walls and corner structures.

Containers fabricated from paperboard and/or corrugated paperboard materials are often used to store and transport goods. These containers can include four-sided containers, six-sided containers, eight-sided containers, bulk bins and/or various size corrugated barrels. These containers may be stacked atop one another for storage, transport, and/or display purposes.

Such containers are usually formed from blanks by an apparatus that folds a plurality of panels along preformed fold lines and seals these panels with an adhesive to form an erected corrugated container. Containers may have certain strength requirements for transporting products. These strength requirements may include a stacking strength requirement such that the containers can be stacked on one another without collapsing during transport, storage, and/or display. However, if the containers are not properly aligned when stacked or the stacking strength of the container does not meet strength requirements, the containers may be unstable and collapse.

Accordingly, there is a need for a container that facilitates proper stacking and meets desired strength requirements. Further, there is a need for a machine that efficiently forms such containers from blank sheet material.

BRIEF DESCRIPTION OF THE INVENTION

In one aspect, an apparatus for forming a container is provided. The apparatus comprises a hopper assembly configured to store a plurality of blanks. Each blank includes a bottom panel, a pair of opposing end panels, at least one stacking tab, at least one inner side panel, and at least one outer side panel. A transport mechanism is positioned below the hopper assembly and is configured to transport a blank of the plurality of blanks from a first position to a second position. A pair of opposing folding plows is positioned below the hopper assembly. The folding plows are configured to rotate the inner side panels and the stacking tabs of the blank as the blank is transported from the first position to the second position. The apparatus further includes at least one stacking tab bullet coupled to each folding plow. Each stacking tab bullet is configured to move a respective stacking tab relative to a corresponding inner side panel.

In another aspect, a method for forming a container is provided. The method comprises transporting a blank from a first position to a second position within a hopper assembly using a transport mechanism positioned below the hopper assembly. The blank includes a bottom panel, a pair of opposing end panels, at least one stacking tab, at least one inner side panel, and at least one outer side panel. The inner side panels and the stacking tabs of the blank are then rotated by a pair of opposing folding plows as the blank is transported from the first position to the second position. The pair of opposing folding plows is positioned below the hopper assembly. Each stacking tab is moved relative to a corresponding inner side panel using a respective stacking tab bullet. At least one stacking tab bullet is coupled to each folding plow.

DETAILED DESCRIPTION OF THE INVENTION

Figure 1:
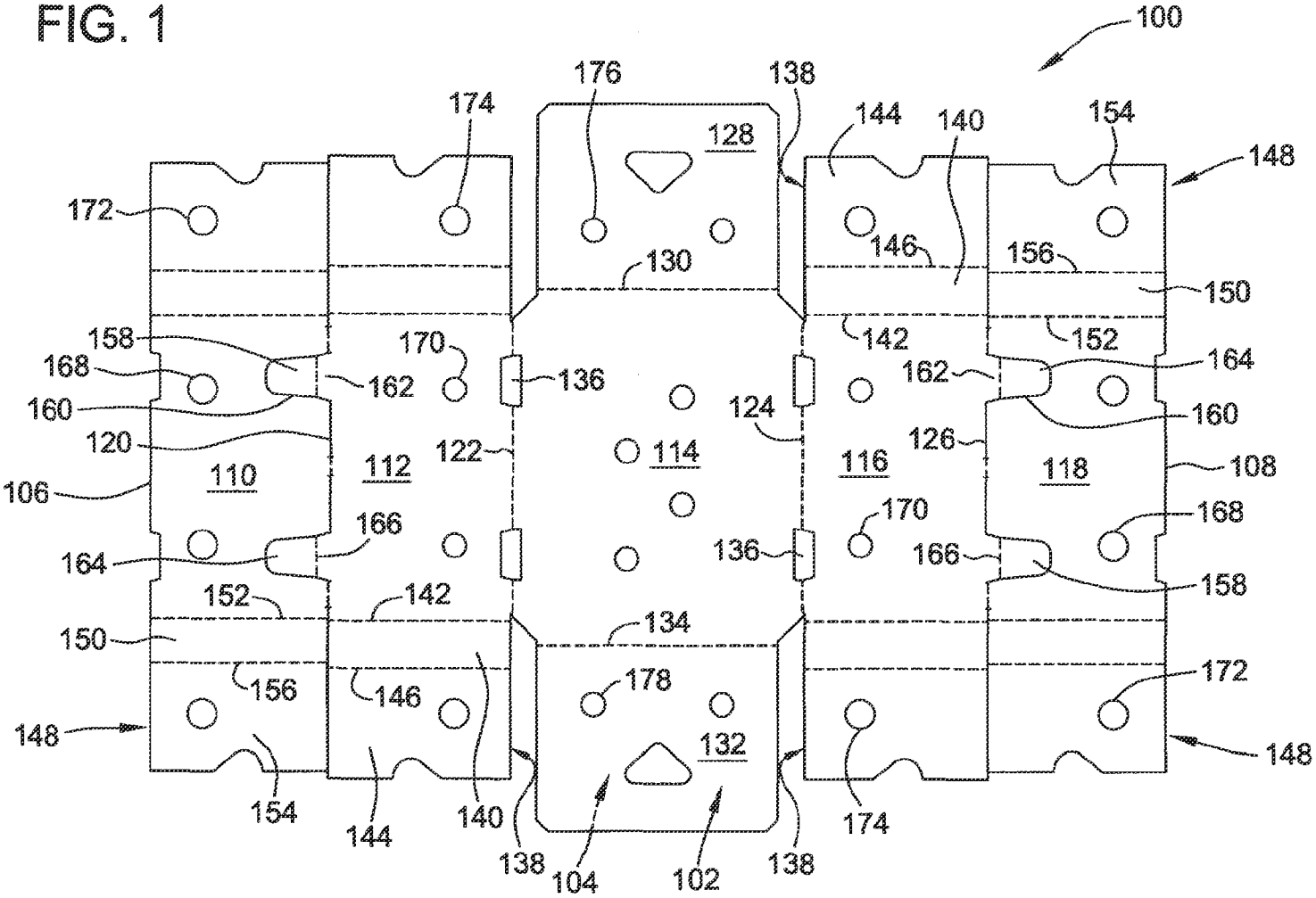
FIG. 1 is a top plan view of an exemplary embodiment of a blank of sheet material.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides an apparatus for forming a stackable, reinforced container formed from a single sheet of material. The container is sometimes referred to as a reinforced mitered tray or a reinforced eight-sided tray. In one embodiment, the container is fabricated from a paperboard material. The container, however, may be fabricated using any suitable material, and therefore is not limited to a specific type of material. In alternative embodiments, the container is fabricated using cardboard, fiberboard, paperboard, foamboard, corrugated paper, and/or any suitable material known to those skilled in the art and guided by the teachings herein provided. The container may have any suitable size, shape, and/or configuration, whether such sizes, shapes, and/or configurations are described and/or illustrated herein. Further, different embodiments described here can vary in size and/or dimensions. The container may also include lines of perforation for removal of a portion of the container for displaying articles for sale.

The container is sometimes referred to as a reinforced eight-sided tray that is formed by a mandrel driving a partially formed tray through a forming section of the apparatus. The container may be constructed from a blank of sheet material using at least one machine. A blank used for forming the container is described below in detail.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

It should be understood that features included in one embodiment can be used with other embodiments described herein. Further, any of the containers described herein may include handles defined through end and/or side walls thereof. Moreover, vent holes, can be defined through any suitable panel in any of the embodiments and have any suitable size, shape, orientation, and/or location that enable the below-described blanks and containers to function as described herein. Still further, the containers described herein can include adhesives such as, but not limited to, glue, tape and sealing strips which can have any suitable size, shape, orientation, and/or location that enable the below-described blanks and containers to function as described herein.

Figure 2:
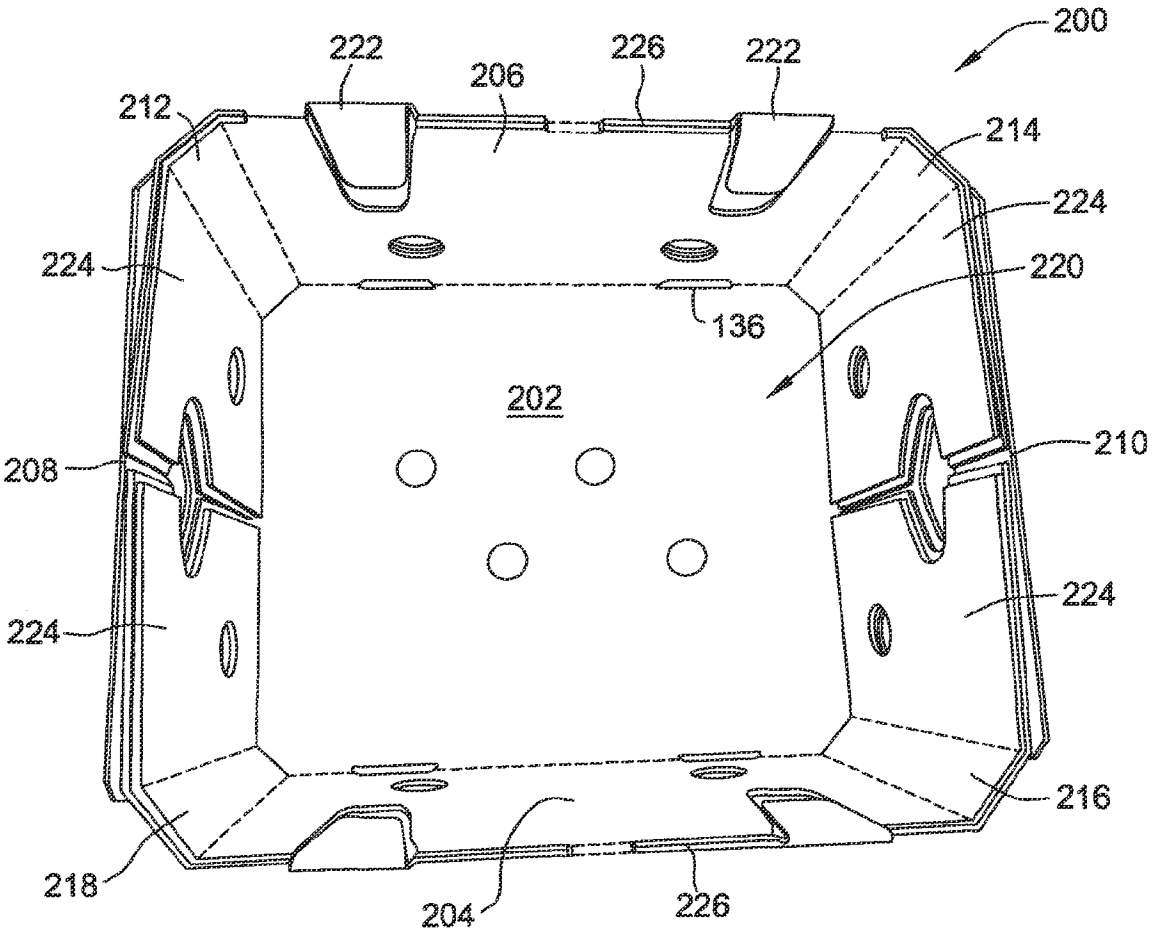
FIG. 2 is a perspective view of a container formed from the blank shown in FIG. 1.

Referring now to the drawings, FIG. 1 is a top plan view of an exemplary blank 100 of sheet material for forming a container 200 (shown in FIG. 2). Blank 100 has a first or interior surface 102 and an opposing second or exterior surface 104. Further, blank 100 defines a first edge 106 and an opposing second edge 108. In one embodiment, blank 100 includes, in series from first edge 106 to second edge 108, a first inner side panel 110, a first outer side panel 112, a bottom panel 114, a second outer side panel 116, and a second inner side panel 118 coupled together along preformed, generally parallel, fold lines 120, 122, 124, and 126, respectively.

A first end panel 128 extends from a first end edge of bottom panel 114 along a fold line 130, and an opposing second end panel 132 extends from a second end edge of bottom panel 114 along a fold line 134. In the exemplary embodiment, a pair of slots 136 is defined along each fold line 122 and 124. Slots 136 are configured to receive a stacking tab from a lower container, as described in more detail below.

An outer corner assembly 138 extends from each side edge of each outer side panel 112 and 116. As such, blank 100 includes four outer corner assemblies 138. Each outer corner assembly 138 includes an outer corner panel 140 extending from a respective outer side panel 112 or 116 at a fold line 142 and an outer end panel 144 extending from a respective outer corner panel 140 at a fold line 146. Fold lines 142 and 146 are substantially perpendicular to fold lines 120, 122, 124, and 126.

An inner corner assembly 148 extends from each side edge of each inner side panel 110 and 118. As such, blank 100 includes four inner corner assemblies 148. Each inner corner assembly 148 includes an inner corner panel 150 extending from a respective inner side panel 110 or 118 at a fold line 152 and an inner end panel 154 extending from a respective inner corner panel 150 at a fold line 156. Fold lines 152 and 156 are substantially perpendicular to fold lines 120, 122, 124, and 126 and are scored to facilitate ease of rotation.

A pair of stacking tabs 158 is defined within panels 110 and 112 and within panels 116 and 118. More specifically, each tab 158 is defined by a cut line 160 that interrupts fold line 120 or 126 and extends from an outer side panel 112 or 116 into an adjacent inner side panel 110 or 118. Each tab 158 includes a first portion 162 and a second portion 164 defined by a fold line 166. First portion 162 extends from a respective outer side panel 112 or 116 and into inner side panel 110 or 118, and second portion 164 is defined within a respective inner side panel 110 or 118. In the exemplary embodiment, each tab 158 is aligned with a slot 136. Inner side panels 110 and 118 of blank 100 are slightly narrower than outer side panels 112 and 116. Accordingly, fold lines 152 and 156 of inner side panels 110 and 118 are marginally offset towards stacking tabs 158 from fold lines 142 and 146 of outer side panels 112 and 116.

Blank 100 also includes a plurality of venting apertures 168, 170, 172, 174, 176, and 178. Inner side panels 110 and 118 each include two apertures 168, outer side panels 112 and 116 each include two apertures 170, each inner end panel 154 includes aperture 172, each outer end panel 144 includes aperture 174, first end panel 128 includes two apertures 176, and second end panel 132 includes two apertures 178. As described in further detail below, apertures 172 of two inner end panels 154 are configured to be aligned with apertures 174 of adjacent two outer end panels 144 and one of an aperture 176 of first end panel 128 or an aperture 178 of second end panel 132. Further, apertures 168 of inner side panels 110 and 118 are configured to be aligned with apertures 170 of adjacent outer side panel 112 and 116. In the exemplary embodiment, each venting aperture 168, 170, 172, 174, 176, and 178 is substantially circular shaped and is configured to align as described above. However, it should be understood that venting aperture 168, 170, 172, 174, 176, and 178 can have any suitable size, shape, and/or configuration that enables blank 100 to function as described herein.

FIG. 2 is a perspective view of an exemplary container 200 formed from blank 100 (shown in FIG. 1). Container 200 includes a bottom wall 202, a first side wall 204, an opposing second side wall 206, a first end wall 208, an opposing second end wall 210, and four corner walls 212, 214, 216, and 218 defining a cavity 220. Slots 136 are defined at least in bottom wall 202.

Referring to FIGS. 1 and 2, to form container 200 from blank 100, inner side panel 110 is rotated about fold line 120 toward interior surface 102 of outer side panel 112 until interior surface 102 of inner side panel 110 is substantially in contact with interior surface 102 of outer side panel 112 similarly, inner side panel 118 is rotated about fold line 126 toward interior surface 102 of outer side panel 116 until interior surface 102 of inner side panel 118 is substantially in contact with interior surface 102 of outer side panel 116. At least interior surface 102 of inner end panels 154 is coupled to interior surface 102 of respective adjacent outer end panels 144. Outer side panel 112 and inner side panel 110 define first side wall 204, and outer side panel 116 and inner side panel 118 define second side wall 206. Side wall 204 includes a top edge 226 that is at least partially defined by fold line 120. Similarly, side wall 206 includes a top edge 226 that is at least partially defined by fold line 126.

Second portion 164 of each tab 158 is rotated about fold line 166 toward a respective first portion 162, and interior surfaces 102 of second portions 164 are coupled to interior surfaces 102 of first portions 162. As such, at least a portion of outer side panels 112 and 116 form a plurality of stacking tabs 222 extending upward from each side wall 204 and 206. Adhesives, such as, but not limited to, glue, tape, and sealing strips are applied to at least one of second portion 164 of tab 158 and a portion of outer side panels 112 and 116 to facilitate formation of stacking tabs 222. Slots 136 of a first upper container 200 are configured to receive stacking tabs 222 of a lower second container 200 when upper and lower containers 200 are stacked.

Each outer corner panel 140 is coupled in a face-to-face relationship with a respective adjacent inner corner panel 150. Outer corner panels 140 are rotated about fold line 142 toward an adjacent side wall 204 or 206. As such, each inner corner panel 150 rotates toward an adjacent side wall 204 or 206 about scored fold line 152. Scored fold line 152 enables inner corner panel 150 to easily rotate with respect to inner side panel 110. Each outer corner panel 140 and inner corner panel 150 pair defines a corner wall 212, 214, 216, or 218. In the exemplary embodiment, each corner wall 212, 214, 216, and 218 provide structural strength to container 200.

Similarly, each outer end panel 144 is rotated about a respective fold line 146 toward an adjacent corner wall 212, 214, 216, or 218. As such, each inner end panel 154 rotates toward an adjacent corner wall 212, 214, 216, or 218 about scored fold line 156. Scored fold line 156 enables inner corner panel 150 to easily rotate with respect to inner side panel 110. Each outer end panel 144 and inner end panel 154 pair defines an inner end assembly 224. Inner end assemblies 224 are substantially perpendicular to side walls 204 and 206. The structure of inner end assemblies 224 transfers loads from above-stacked containers to bottom wall 202 instead of on any adhesive used to couple end assemblies 224 to end panels 128 and 132. Accordingly, inner end assemblies 224 provides container 200 with additional stacking strength and prevents side walls 204 and 206 from collapsing outward.

Each side wall 204 and 206 is rotated about a respective fold line 122 or 124 toward interior surface 102 of bottom wall 202 defined by bottom panel 116. More specifically, side walls 204 and 206 are rotated to be substantially perpendicular to bottom wall 202. As side walls 204 and 206 are rotated, corner walls 212, 214, 216, and 218 and inner end assemblies 224 rotate toward bottom wall 202 to be substantially perpendicular to bottom wall 202.

First end panel 128 is rotated about fold line 130 toward interior surface 102 of bottom wall 202, and second end panel 132 is rotated about fold line 134 toward interior surface 102 of bottom wall 202. A pair of inner end assemblies 224 adjacent to first end panel 136 is coupled to interior surface 102 of first end panel 136 to form first end wall 208. Similarly, a pair of inner end assemblies 224 adjacent to second end panel 140 is coupled to interior surface 102 of second end panel 140 to form second end wall 210.

Figure 3:
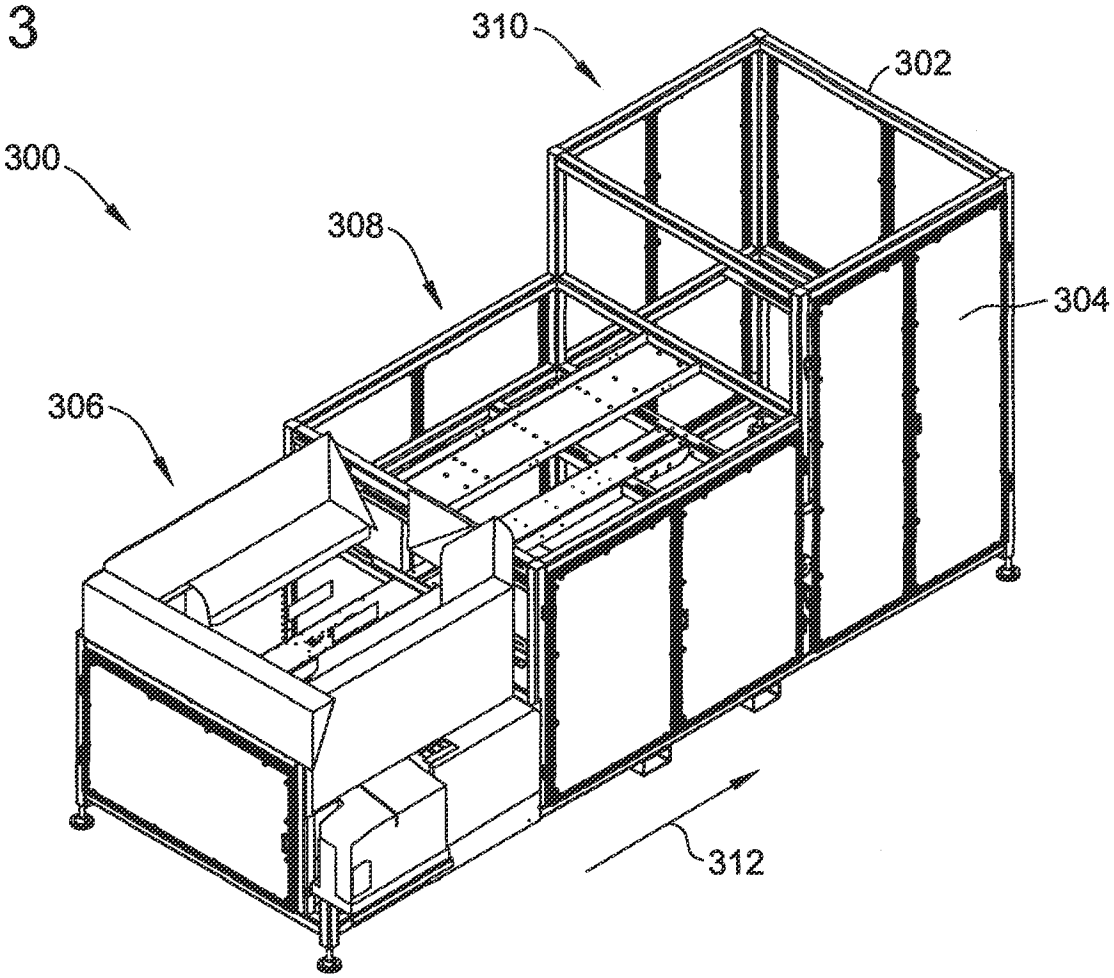
FIG. 3 is a perspective view of an exemplary container forming apparatus used to form the container shown in FIG. 2.

FIG. 3 illustrates an exemplary container forming apparatus 300 for forming blank 100 into fully formed container 200. Container forming apparatus 300 generally includes a hopper station 306, a laminating station 308, and a compression station 310. The hopper station 306 is positioned in the front of apparatus 300 with respect to a direction of arrow 312. Laminating station 308 is positioned downstream of hopper station 306, and compression station 310 is positioned downstream from laminating station 308. Hopper station 306 includes a hopper assembly 400 (shown in FIG. 4). Laminating station 308 includes an adhesive application assembly 500 (shown in FIGS. 5 and 7) a laminating assembly 700 (shown in FIGS. 5-7), a cam assembly 800 (shown in FIG. 6), and a roller assembly 600 (shown in FIGS. 5 and 7). Compression station 310 includes a mandrel assembly 900 (shown in FIGS. 8 and 9), a compression assembly 1000 (shown in FIG. 9), and a conveyor assembly 1100 (shown in FIG. 10).

Container forming apparatus 300 further includes frame members 302 to which a plurality of protective panels 304 are coupled. Protective panels 304 prevent external objects from interfering with operation of apparatus 300. Protective panels 304 may be made of plastic, glass, and/or any suitable material that facilitates protecting components of apparatus 300. In the exemplary embodiment, protective panels 304 are substantially transparent, enabling an operator to visually monitor operation of apparatus 300.

Figure 4:
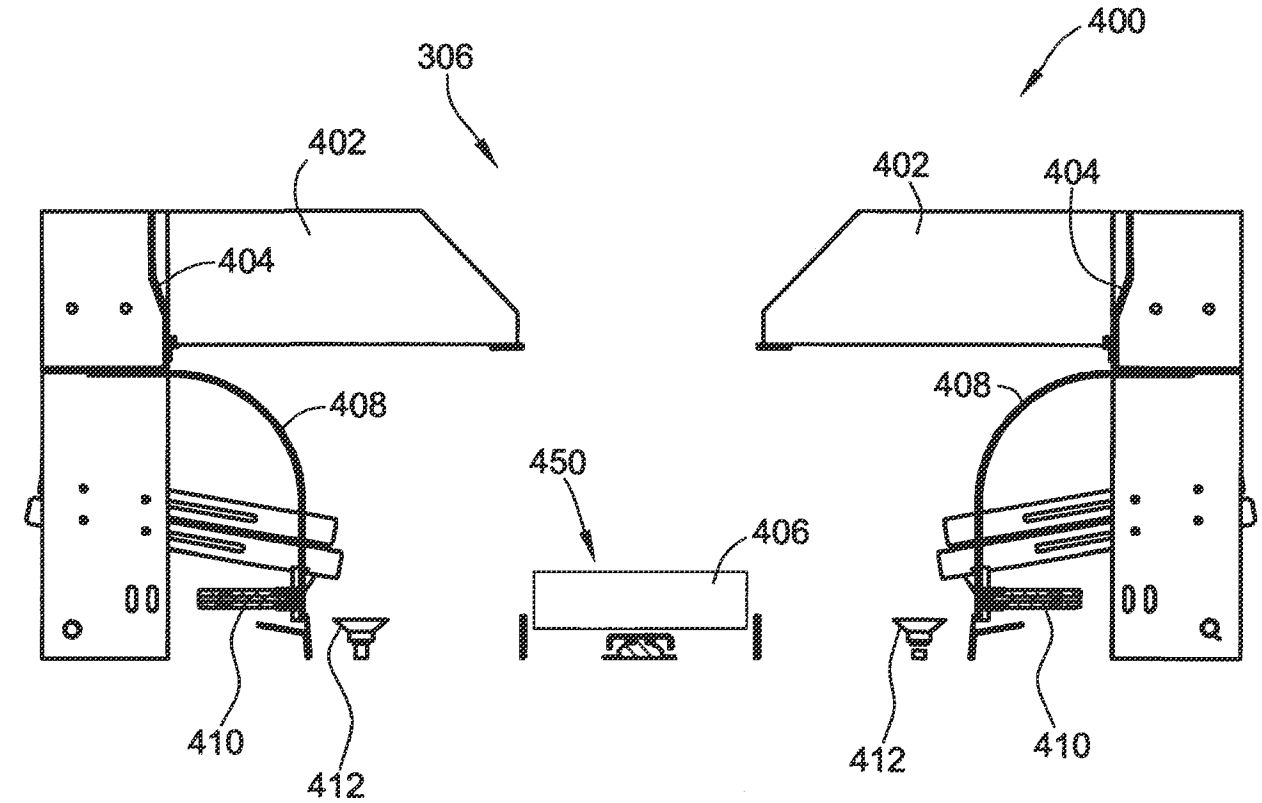
FIG. 4 is a cross-sectional view of an exemplary hopper assembly of the apparatus shown in FIG. 3.

FIG. 4 shows exemplary hopper assembly 400 of hopper station 306. Hopper assembly 400 is configured to hold a plurality of blanks 100 (shown in FIG. 1) and generally includes opposing hopper side walls 404, a first hopper end wall 402, an opposing blank guide arm (not shown) configured to maintain a plurality of blanks 100 in proper placement. Hopper assembly 400 also includes removable opposing side panel folding plows 408 and a plurality of stacking tab bullets 410 that extend at least partially through a corresponding folding plow 408 to strike and fold inward stacking tabs 158 relative to a corresponding inner side panel 110 or 118 of blank 100. In the exemplary embodiment, apparatus 300 includes four stacking tab bullets 410 for striking each respective tab 158 of blank 100 at a predetermined time. In the exemplary embodiment, stacking tab bullets 410 are actuating cylinders that pneumatically transition between an unfired position (shown in FIG. 4) and a fired position (not shown). Hopper assembly 400 further includes a transport mechanism, such as a plurality of vacuum cups 412, which is positioned beneath walls 402 and 404 of hopper assembly and beneath side panel folding plows 408. Vacuum cups 412 are configured to retrieve a single blank 100 from the plurality of blanks 100. Vacuum cups 412 retrieve blank 100 from a first position within walls 402 and 404 and transfer blank 100 to a second position on a blank drive system 450 that includes a kicker plate 406 and a roller assembly (shown in FIGS. 5 and 7) for feeding blank 100 through container forming apparatus 300.

As blank 100 is transported from the first position to the second position, vacuum cups 412 drag blank 100 between opposing side panel folding plows 408 such that exterior surface 104 of inner side panels 110 and 112 and corner assemblies 148 contact side panel folding plows 408. More specifically, side panel folding plows 408 are positioned between hopper walls 402 and 404 and vacuum cups 412 and are configured to rotate inner side panels 110 and 118 and corner assemblies 148 along respective fold lines 120 and 126 toward interior surface 102 of outer side panels 112 and 116 and corner assemblies 138 such that inner side panels 110 and 118 are perpendicular to outer side panels 112 and 116. When inner side panels 110 and 118 are perpendicular to outer side panels 112 and 116, respectively, stacking tab bullets 410 fire through a lower portion of side panel folding plows 408 to break perforated cut line 160 and rotate second portion 164 of tab 158 about fold line 166 toward first portion 162. Side panel folding plows 408 are further configured to maintain tab 158 in an upright position perpendicular to outer side panels 112 and 116 in a transition from hopper station 306 to laminating station 308. After blank 100 passes through side panel folding plows 408, kicker plate 406 fires to transport blank 100 downstream to laminating station 308.

Figure 5:
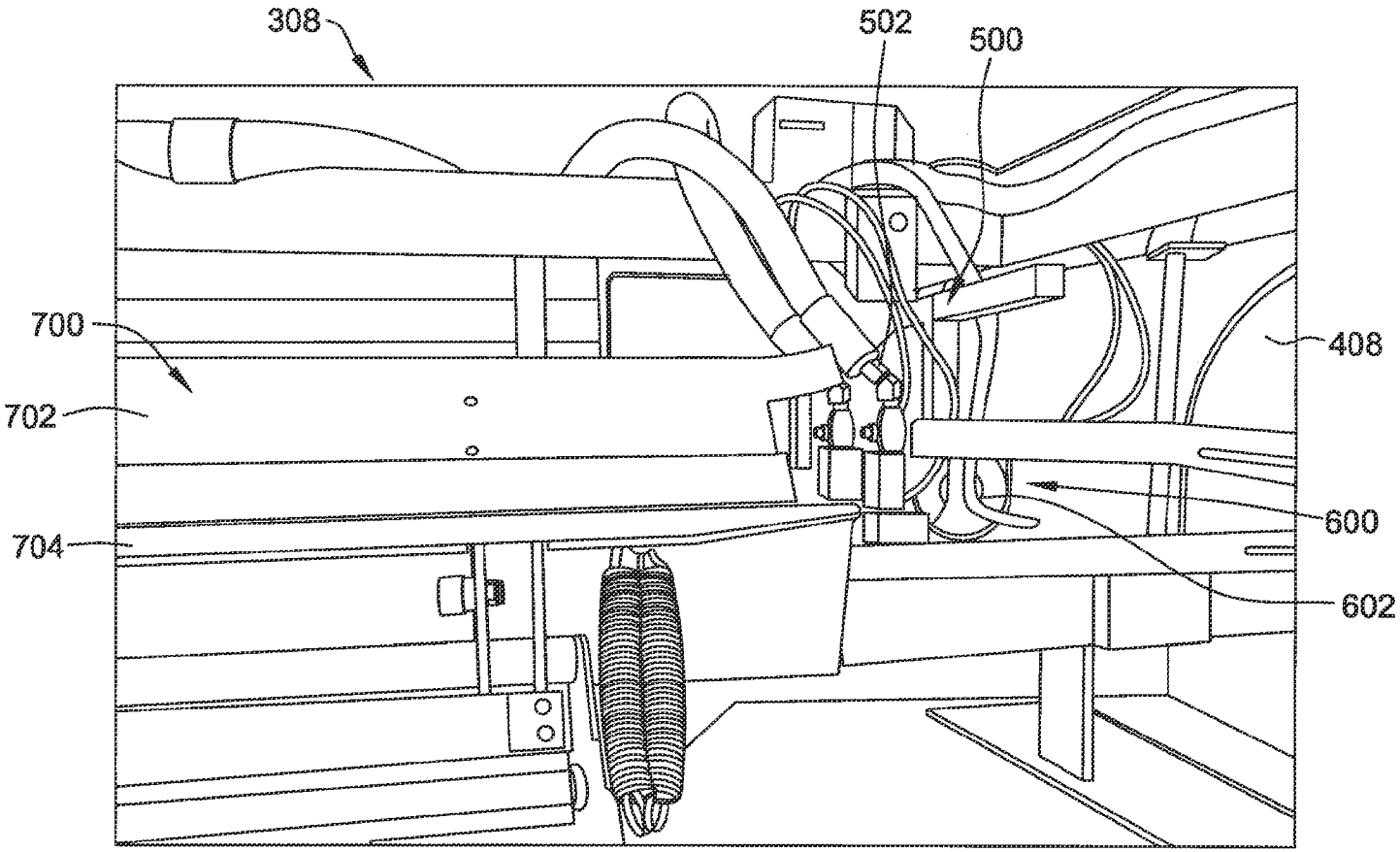
FIG. 5 is a perspective view of a portion of an adhesive application assembly located between the hopper assembly and a laminating assembly of the apparatus shown in FIG. 3.
Figure 6:
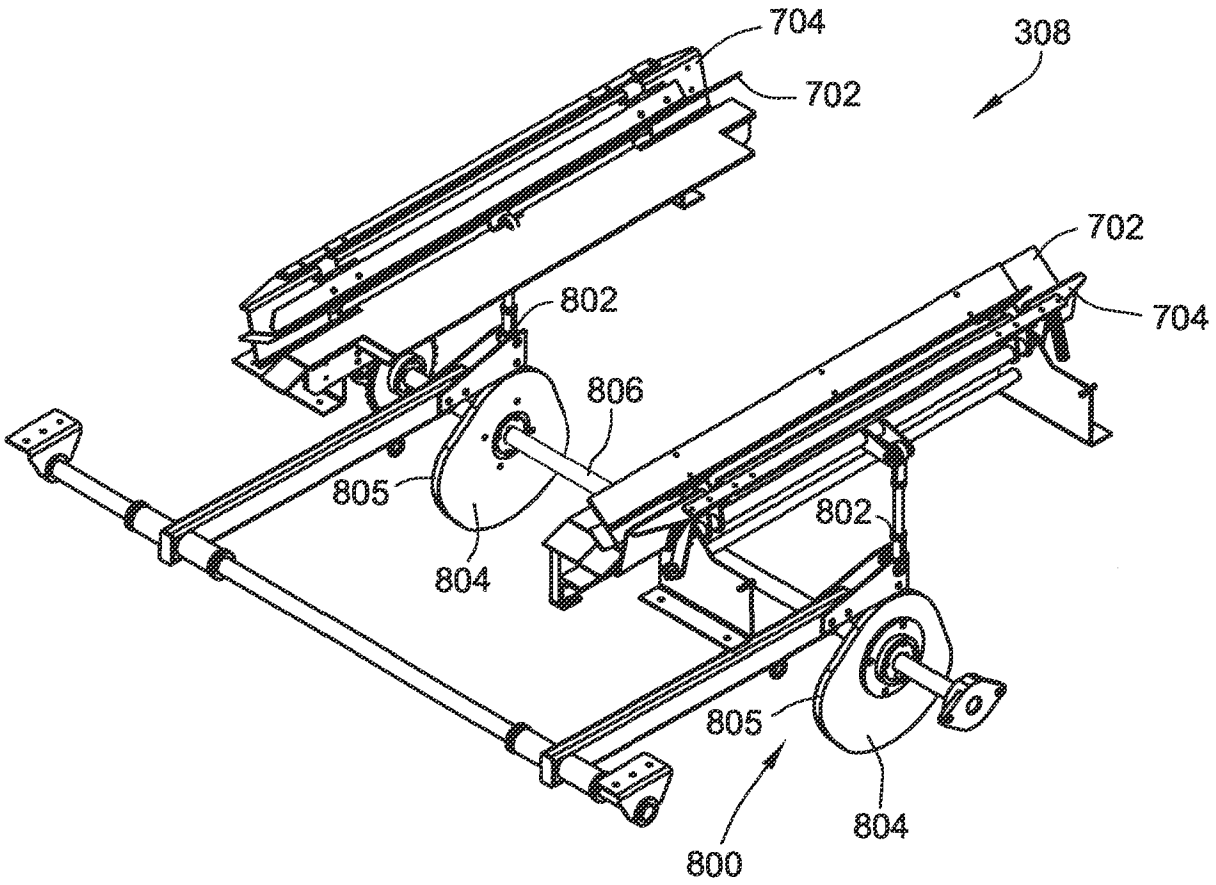
FIG. 6 is a perspective view of the exemplary laminating assembly and an exemplary cam assembly of the apparatus shown in FIG. 3.
Figure 7:
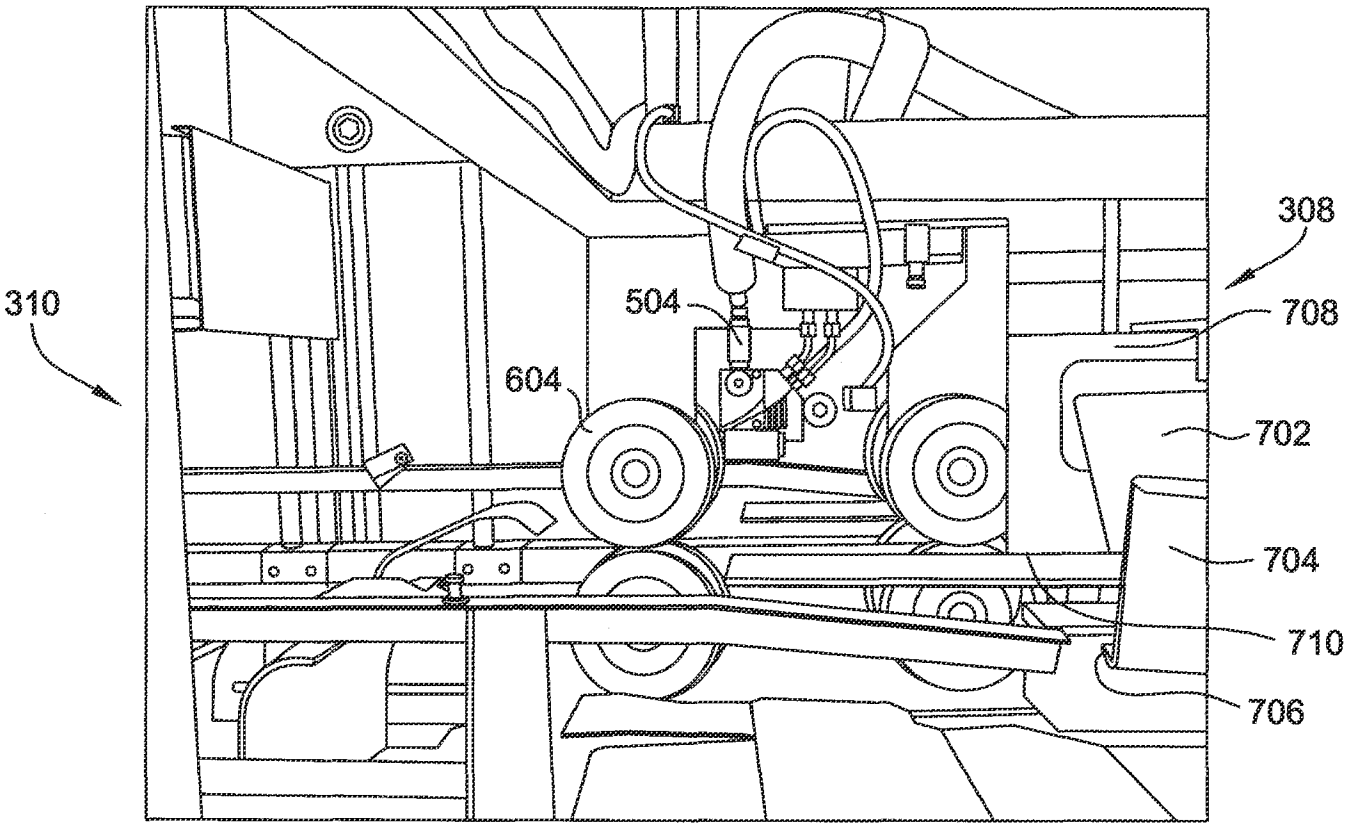
FIG. 7 is a perspective view of a second portion of the adhesive application assembly located between the laminating assembly and a compression assembly of the apparatus shown in FIG. 3.

FIGS. 5-7 illustrate laminating station 308 of container forming apparatus 300. Laminating station 308 includes adhesive application assembly 500, roller assembly 600, a laminating assembly 700, and a cam assembly 800. Assemblies 500, 600, 700, and 800 operate conjunctively to laminate blank 100 in preparation for forming by compression station 310. Adhesive application assembly 500 includes a first glue application device 502 (shown in FIG. 5) positioned between hopper station 306 and laminating station 308 (both shown in FIG. 3), and a second adhesive application device 504 (shown in FIG. 7) positioned between laminating station 308 and compression station 310 (shown in FIG. 3). Roller assembly 600 includes a first set of rollers 602 configured to transport blank 100 along the blank drive system in the direction of arrow 312 from hopper station 306 to laminating station 308, and a second set of rollers 604 configured to transport blank 100 from laminating station 308 to compression station 310. Similar to adhesive application devices 502 and 504, first set of rollers 602 is positioned between hopper station 306 and laminating station 308, and second set of rollers 604 is positioned between laminating station 308 and compression station 310.

In the exemplary embodiment, laminating assembly 700 of laminating station 308 is located downstream of first adhesive application device 502. Laminating assembly 700 includes two laminating plates 702, two squaring arms 704, and two squaring plates 708. More specifically, laminating assembly 700 includes one laminating plate 702, squaring arms 704, and on squaring plate 708 positioned on opposites sides of blank 100 as it passes through laminating station 308. Further, each arm 704 includes a squaring edge 706 and each plate 708 includes a squaring edge 710. Cam assembly 800 is located beneath laminating assembly 700 within container forming apparatus 300.

Compressed air operated kicker plate 406 pushes blank 100 with inner side panels 110 and 118 and corner assemblies 148 rotated about fold lines 120 and 126, respectively, as described above, toward first set of rollers 602. In the exemplary embodiment, rollers 602 transport blank 100 downstream from hopper assembly 400 of hopper station 306 to laminating assembly 700 of laminating station 308. During such transition, first adhesive application device 502 applies adhesive to interior surface 102 of outer side panels 112 and 116, to first portions 162 of tabs 158, and to corner assemblies 138. Blank 100 then enters laminating assembly 700 such that one laminating plate 702, one squaring arm 706, and one squaring plate 708 are positioned on either side of blank 100.

Cam assembly 800 includes a cam follower 802 and two cams 804 separated by an axle 806. Each cam 804 includes a specifically-shaped outer circumference 805 traced by cam follower 802 that facilitates operation of laminating assembly 700. Laminating assembly 700 is coupled to cam assembly 800 via two cam followers 802. Each squaring arm 704 is coupled to a cam follower 802 that is coupled to a respective cam 804 of cam assembly 800. Cams 804 and axle 806 are driven by at least one motor coupled to pluralities of gears and chains, which are configured to rotate cams 804 about axle 806 at a predetermined speed to facilitate operation of laminating assembly 700 and container forming apparatus 300. More specifically, cam followers 802 follow outer circumference 805 during rotation of cams 804 such that when cam followers 802 are at a high point of circumference 805, with respect to axle 806, laminating plate 702 and squaring arm 704 are facilitated to lower to laminate side panels 110 and 118 to side panels 112 and 116, respectively, and when cam followers 802 are at a low point of circumference 805, laminating plate 702 and squaring arm 704 are facilitated to rise to allow blank 100 to continue in container forming apparatus 300 and to accept a new blank 100 for lamination.

In the exemplary embodiment, cam 804 and outer circumference 805 include a double action that is configured to firstly square panel 110 with respect to panel 112 and panel 116 with respect to panel 118, and secondly, to laminate panels 110 and 112 together to form side wall 204, laminate panels 116 and 118 together to form side wall 206, and laminate corner assemblies 138 and 148 together to form end assemblies 224. More specifically, during the first action, cam followers 802 engage squaring arms 704 such that one squaring arm edge 706 squares panels 110 and 112 along folding line 120 to form top edge 226 of side wall 204, and opposing squaring arm edge 706 squares panels 116 and 118 along folding line 126 to form top edge 226 of side wall 206. Simultaneously, squaring arm edges 706 rotate inner side panels 110 and 118 over fold lines 120 and 126 such that edges 106 and 108 contact distal edge 710 of opposing stationary squaring plates 708. Squaring plates 708, each including squaring plate edge 710, are configured to prevent edges 106 and 108 from over-rotating and to facilitate proper squaring of panels 110 and 112 and panels 116 and 118 to form side wall 204 and side wall 206, respectively.

When panels 110 and 112 and panels 116 and 118 are squared and edges 106 and 108 are substantially flush with fold lines 120 and 126, the second action of cam assembly 800 engages cam follower 802 to engage laminating plates 702. More specifically, laminating plates 702 force inner side panels 110 and 118 into a face-to-face relationship with outer side panels 112 and 116, respectively, and force corner assemblies 138 into a face-to-face relationship with corner assemblies 148. Subsequently, laminating plates 702 seal the panels and assemblies together to form side walls 204 and 206, corner walls 212, 214, 216, 218, and end assemblies 224. The adhesive applied to blank 100 by first adhesive application device 502 facilitates lamination of blank 100 to partially form container 200.

In the exemplary embodiment, second set of rollers 604 receives laminated blank 100 from lamination station 408 and directs blank 100 downstream in the direction of arrow 312 (shown in FIG. 3) toward compression station 310. First and second sets of rollers 602 and 604 of roller assembly 600 are configured to convey blank 100 downstream within forming apparatus 300 from hopper station 306, through laminating station 308, and up to compression station 310. During conveyance from laminating station 308 to compression station 310, second adhesive application device 504 applies glue, or any suitable adhesive to at least one of end assemblies 224 and end panels 128 and 132 to facilitate formation of end walls 208 and 210 in compression station 310.

Figure 8:
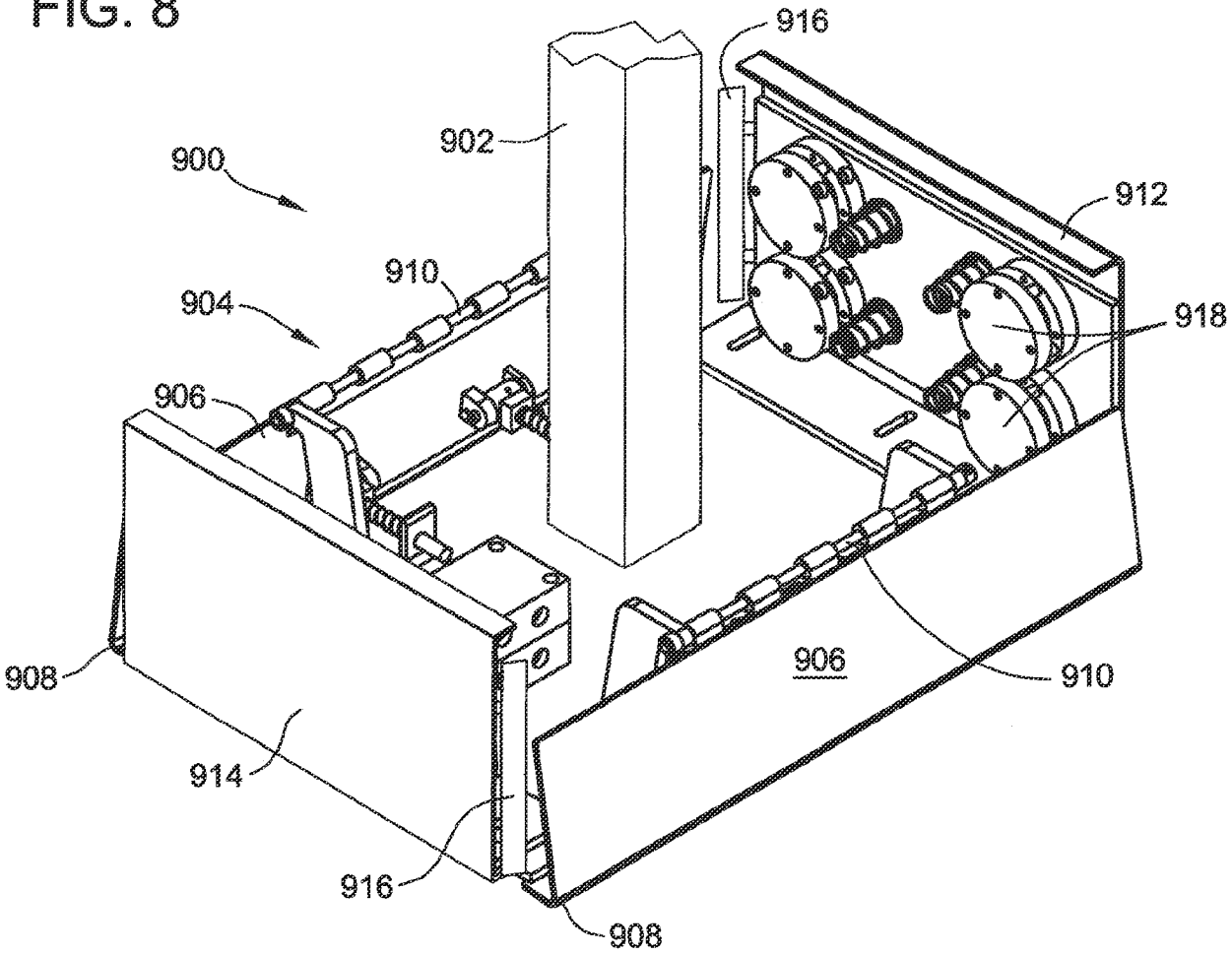
FIG. 8 is a perspective view of an exemplary mandrel assembly of the apparatus shown in FIG. 3.

FIG. 8 illustrates mandrel assembly 900 in compression station 310 of container forming apparatus 300. A mandrel drive 902 is coupled to a main body 904 of mandrel assembly 900 to facilitate transition between a first position proximate to blank 100 and a second position where mandrel assembly 900 is biased against blank 100 for driving blank 100 downward through the compression assembly (shown in FIG. 9). In the exemplary embodiment, mandrel drive 902 is a compression shaft operated by a servo-controlled machine. Mandrel assembly 900 includes opposing spring-loaded side plates 906, having bottom edges 908, coupled to mandrel main body 904 via hinges 910. Each end of mandrel main body 904 includes an end compression plate 912. Each end compression plate 912 includes an end face 914 configured to form at least a portion of end walls 208 and 210. Mandrel body 904 further includes a stationary corner face 916 in each corner of mandrel body 904. Each corner face 916 configured to form one of corner walls 212, 214, 216, and 218. Each end compression plate 912 includes two corner faces 916. Mandrel assembly 900 further includes at least one actuator 918 coupled to each end compression plate 912. In the exemplary embodiment of container forming apparatus 300, mandrel assembly 900 includes two end compression plates 912 and eight actuators 918 such that four actuators 918 are configured to outwardly fire from each end compression plate 912. Furthermore, actuators 918 are positioned at a right angle with respect to side faces 906 such that each end face 914 is fired directly outward in opposing directions.

Figure 9:
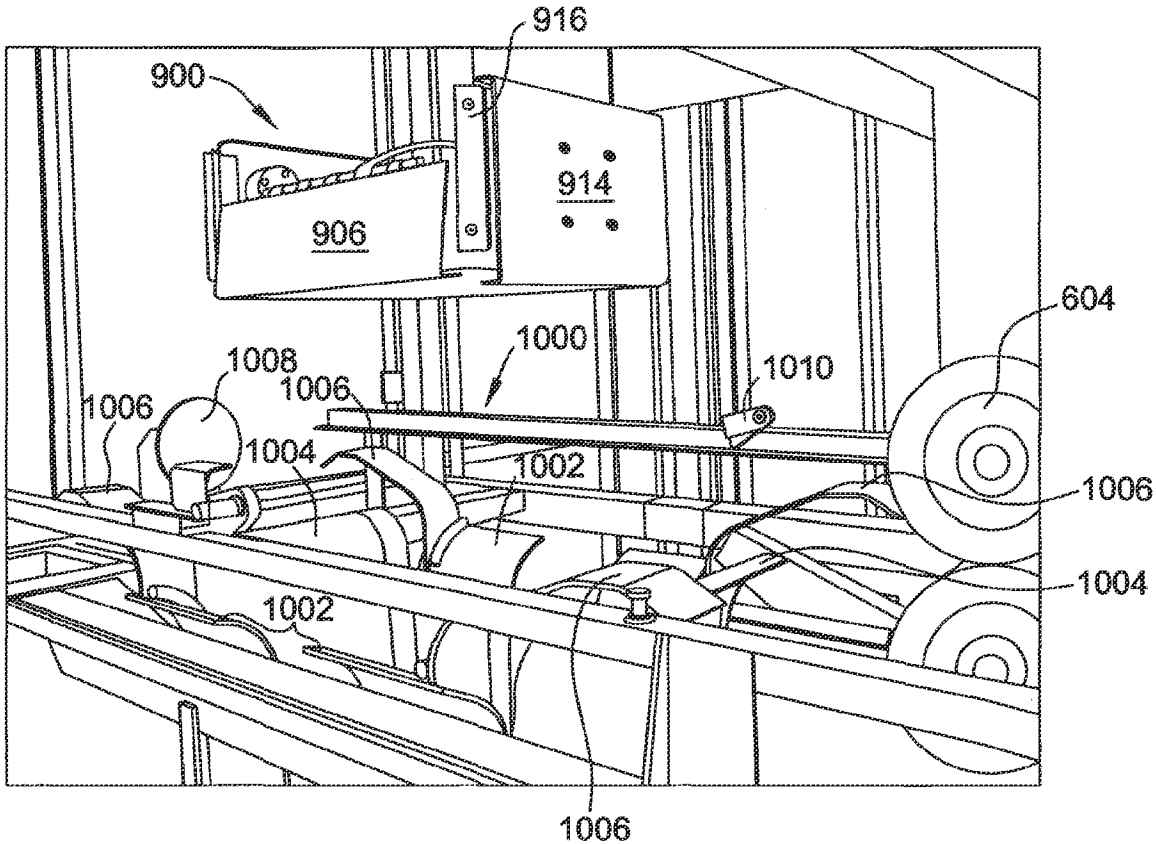
FIG. 9 is a perspective view of the mandrel assembly and the compression assembly of the apparatus shown in FIG. 3.

FIG. 9 shows compression assembly 1000 in compression station 310 of container forming apparatus 300 where container 200 is formed from laminated blank 100. In the exemplary embodiment, compression assembly 1000 includes a plurality of side wall forming plates 1002 configured to form side walls 204 and 206 and also includes at least two end wall forming plates 1004 configured to form end walls 208 and 210. Compression assembly 1000 further includes four corner forming plates 1006 configured to facilitate formation of corner walls 212, 214, 216, and 218. Alternatively, compression assembly 1000 may include any number of forming plates required to facilitates operation as described herein. It will be understood that various blanks require different configurations of forming plates, and that container forming apparatus 300 is adaptable to receive varying configurations of forming plates. In the exemplary embodiment, second set of rollers 604 directs blank 100 downstream in the direction of arrow 312 (shown in FIG. 3) into compression station 310 where a stopping plate 1008 and stopping fingers 1010 are configured to properly position laminated blank 100 within compression station 310.

In the exemplary embodiment, rollers 604 receive blank 100 and drive it downstream under stopping fingers 1010 toward compression assembly 1000. Blank 100 contacts stopping plate 1008 and stopping fingers 1010 drop downward after blank 100 passes underneath to prevent blank 100 from rebounding off of stopping plate 1008. Accordingly, laminated blank 100 is positioned underneath mandrel assembly 900, between stopping plate 1008 and stopping fingers 1010, and above forming plates 1002, 1004, and 1006 of compression assembly 1000. Once blank 100 is positioned between mandrel assembly 900 and compression assembly 1000, the servo motor of mandrel assembly 900 drives mandrel drive 902, to move mandrel main body 904 downward and generally into contact with bottom panel 116. Mandrel assembly 900 subsequently drives bottom panel 116 downward a predetermined distance between forming plates 1002, 1004, and 1006.

As mandrel assembly 900 pushes the partially formed container (also described as blank 100) downward through compression assembly 1000, end panels 128 and 132 contact end forming plates 1004 and are rotated about fold lines 130 and 134, respectively, toward end face 914 of end compression plates 912. Also, exterior surface 104 of outer side panels 112 and 116 (also described as side walls 204 and 206) contact side forming plates 1002 and are rotated about fold lines 122 and 124, respectively, toward spring-loaded side faces 906. Moreover, exterior surface 104 of each corner panel 140 (also described as corner walls 212, 214, 216, and 218) contacts one corner forming plate 1006 such that each corner wall 212, 214, 216, and 218 and each end assembly 224 is rotated about fold line 142 toward corner face 916 of end compression plates 912.

Mandrel side faces 906 are spring-loaded to facilitate correcting any imperfections which may have occurred in positioning of blank 100 for forming. The spring-loading feature of side faces 906 also allows for the forming of various containers from blanks other than blank 100 without the need to replace mandrel body 904. Edges 908 of side faces 906 contact blank 100 along fold lines 122 and 124 such that side faces 906 press panels 110 and 112 and panels 116 and 118 against side forming plates 1002 to form side walls 204 and 206 during forming.

When partially formed container 200 is contained within forming plates 1002, 1004, and 1006, actuators 918 of mandrel assembly 900 fire to extend end compression plates 912 outward toward end forming plates 1004. Actuators 918 are operable to extend end compression plates 912 from a retracted first position (shown in FIG. 8) to an extended second position (not shown). The extension of actuators 918 occurs when mandrel assembly 900 is contained within forming plates 1002 and 1004. When actuators 918 actuate end compression plates 912, each end face 914 contacts at least one inner end assembly 224 of partially formed container 200 and pushes end assemblies 224 against end panels 128 and 132 to form end walls 208 and 210 between end faces 914 and end forming plates 1004. Simultaneously, corner faces 916 contact corner panels 150 and push corner panels 150 against corner panels 140 to form corner walls 212, 214, 216, and 218 between corner faces 916 and corner forming plates 1006. Once container 200 is formed by mandrel assembly 900 within compression assembly 1000, container forming apparatus 300 ejects the completed container 200 onto a conveyor assembly (shown in FIG. 10).

Figure 10:
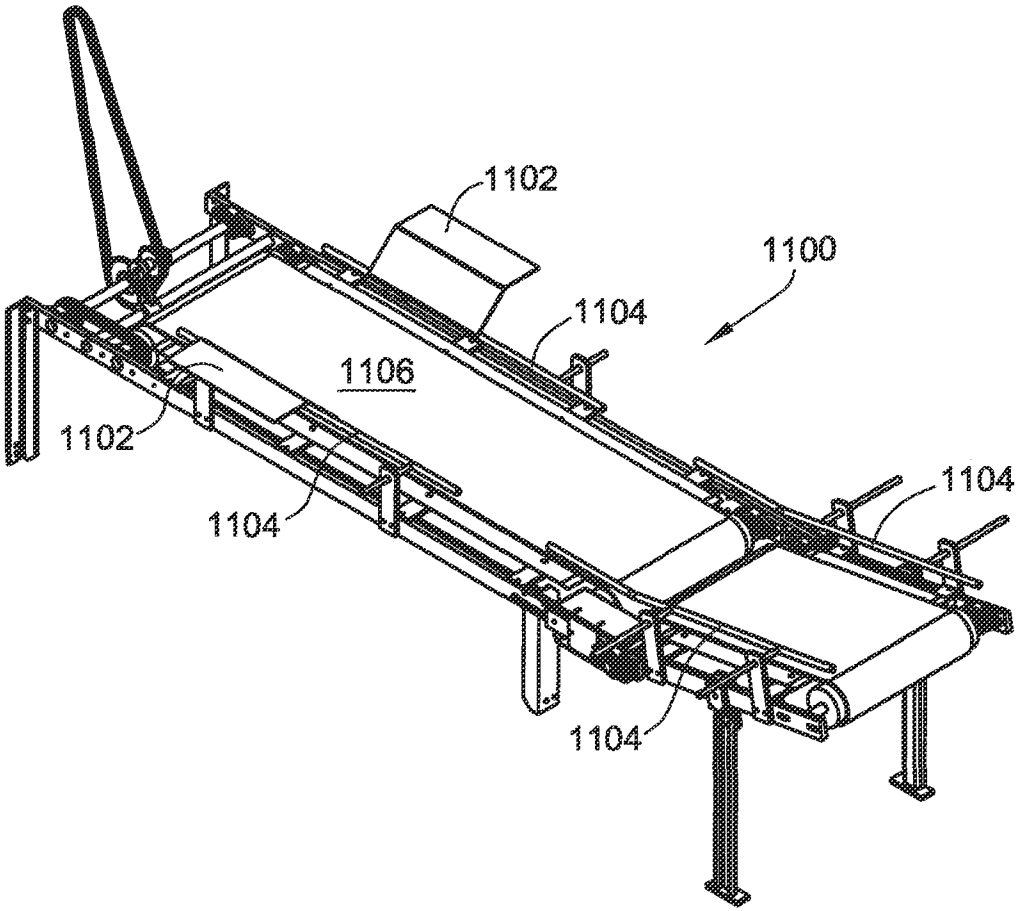
FIG. 10 is a perspective view of an exemplary conveyor assembly of the apparatus shown in FIG. 3.

FIG. 10 illustrates conveyor assembly 1100 of container forming apparatus 300. Conveyor assembly 1100 is positioned beneath compression assembly 1000 within compression station 310 and includes opposing guide walls 1102, opposing guide rails 1104, and a conveyor 1106. Conveyor assembly 1100 may be powered by independent motors, gears, and chains, or by the same of cam assembly 800 to facilitate operation of conveyor assembly 1100. When completed container 200 is discharged from the bottom of compression assembly 1000, guide walls 1102 are configured to properly position container 200 on conveyor 1106. Guide rails 1104 are configured to maintain proper placement of container 200 on conveyor 1106. Conveyor 1106 is configured to receive container 200 from compression assembly 1000 and transport container 200 downstream out of container forming apparatus 200.

Exemplary embodiments of containers formed from blanks and adjustable apparatus for making the same are described above in detail. The container, blank, and apparatus are not limited to the specific embodiments described herein, but rather, components of the blanks, containers, and/or apparatus may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for forming a container, said apparatus comprising:

a hopper assembly storing a plurality of blanks, wherein each blank includes a bottom panel, a pair of opposing end panels, at least one stacking tab, at least one inner side panel, and at least one outer side panel;

a transport mechanism positioned below said hopper assembly, said transport mechanism configured to transport a blank of the plurality of blanks from a first position to a second position;

a pair of opposing folding plows positioned below said hopper assembly, said folding plows configured to rotate the inner side panels and the stacking tabs of the blank as the blank is transported from the first position to the second position; and at least one stacking tab bullet configured to move a respective stacking tab relative to a corresponding inner side panel while said corresponding inner side panel is in contact with at least one of said folding plows.

2. The apparatus according to claim 1, wherein each stacking tab bullet is configured to extend at least partially through a corresponding folding plow.

3. The apparatus according to claim 2, wherein said opposing folding plows are configured to maintain the plurality of stacking tabs in a partially folded position.

4. The apparatus according to claim 1, further comprising an adhesive application assembly including at least one adhesive application device configured to apply adhesive to selected portions of the blank.

5. The apparatus according to claim 1, further comprising a roller assembly including at least one set of rollers configured to transport the blank downstream through said apparatus.

6. The apparatus according to claim 1, further comprising a laminating assembly positioned downstream of said hopper assembly, said laminating assembly comprising:

a pair of opposing squaring arms each including a first squaring edge;

a pair of opposing laminating plates; and a pair of opposing squaring plates including a second squaring edge, wherein said squaring arms, said laminating plates, and said squaring plates are configured to square and laminate selected adjacent portions of the blank when the blank is positioned between each of said pair of opposing squaring arms, said pair of laminating plates, and said pair of squaring plates.

7. The apparatus according to claim 6, further comprising a cam assembly positioned proximate said laminating assembly, said cam assembly comprising:

a cam follower coupled to each opposing squaring arm; and a cam coupled to each cam follower, said cam including a circumference that when traced by said cam follower facilitates operation of said laminating assembly.

8. The apparatus according to claim 1, further comprising a mandrel assembly positioned downstream of said hopper assembly, said mandrel assembly comprising:

a mandrel body; and a mandrel drive coupled to said mandrel body, said mandrel drive configured to facilitate transition of said mandrel body between a first position proximate to the blank and a second position in which said mandrel body is biased against the bottom panel of the blank.

9. The apparatus according to claim 8, said mandrel body comprising:

opposing spring-loaded side faces;

opposing end compression plates; and a plurality of corner faces, wherein said opposing end compression plates and said plurality of corner faces are operated by an actuator to form at least a portion of the container.

10. The apparatus according to claim 1, further comprising a compression assembly comprising:

a plurality of corner forming plates configured to form a corner wall of the container;

a plurality of side forming plates configured to form opposing side walls of the container; and a plurality of end forming plates configured to form opposing end walls of the container.

11. The apparatus according to claim 10, further comprising a conveyor assembly configured to receive the container from said compression assembly and transport the container out of said apparatus.

12. A method for forming a container, said method comprising:

transporting a blank from a first position to a second position within a hopper assembly using a transport mechanism positioned below the hopper assembly, wherein the blank includes a bottom panel, a pair of opposing end panels, at least one stacking tab, at least one inner side panel, and at least one outer side panel;

rotating the inner side panels and the stacking tabs using a pair of opposing folding plows as the blank is transported from the first position to the second position, wherein the pair of opposing folding plows are positioned below the hopper assembly; and moving each stacking tab relative to a corresponding inner side panel using a respective stacking tab bullet while said corresponding inner side panel is in contact with at least one of said folding plows.

13. The method according to claim 12, wherein moving each stacking tab relative to a corresponding inner side panel using a respective stacking tab bullet further comprises extending each stacking tab bullet at least partially through a corresponding folding plow.

14. The method according to claim 12 further comprising applying an adhesive to selected portions of the blank using an adhesive application assembly.

15. The method according to claim 12 further comprising transporting the blank downstream from the second position using a roller assembly.

16. The method according to claim 12 further comprising laminating at least a portion of the blank in a laminating assembly using at least one laminating plate, at least one squaring plate, and at least one squaring arm.

17. The method according to claim 16 further comprising controlling operation of the laminating assembly using a cam assembly, wherein the cam assembly includes at least one cam and at least one cam follower.

18. The method according to claim 17 wherein each cam follower is coupled to a respective squaring arm and wherein each cam follower traces a circumference of the cam to control operation of each squaring arm.

19. The method according to claim 12 further comprising biasing a mandrel assembly against the bottom panel of the blank such that the mandrel assembly drives the blank through a compression assembly having a plurality of forming plates that form the container.

20. The method according to claim 19 further comprising biasing a pair of opposing end compression plates against at least one of the plurality of forming plates to form at least one wall of the container therebetween.

* * * * *